US012692041B2

(12) United States Patent
Cooper et al.

(10) Patent No.: US 12,692,041 B2
(45) **Date of Patent: *Jul. 28, 2026**

(54) TAMPER EVIDENT CONTAINER

(71) Applicant: BROWN LLC, Beaverton, MI (US)

(72) Inventors: David Cooper, Beaverton, MI (US); Mike Mullholand, Beaverton, MI (US)

(73) Assignee: BROWN LLC, Beaverton, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/950,885

(22) Filed: Nov. 18, 2024

(65) Prior Publication Data

US 2026/0028151 A1 Jan. 29, 2026

Related U.S. Application Data

(63) Continuation of application No. 18/786,998, filed on Jul. 29, 2024, now Pat. No. 12,280,912.

(51) Int. Cl.

| | |
|---|---|
| ***B65D 17/28*** | (2006.01) |
| ***B65D 17/00*** | (2006.01) |
| ***B65D 43/16*** | (2006.01) |

(52) U.S. Cl.

CPC ..... *B65D 17/28* (2018.01); *B65D 17/08* (2013.01); *B65D 43/162* (2013.01); *B65D 2401/15* (2020.05)

(58) Field of Classification Search

CPC ..... B65D 17/28; B65D 17/08; B65D 43/162; B65D 2401/15

See application file for complete search history.

(56) References Cited

U.S. PATENT DOCUMENTS

| | | | | |
|---|---|---|---|---|
| 10,494,161 | B2 * | 12/2019 | Fosse | B65D 43/22 |
| 12,280,912 | B1 * | 4/2025 | Cooper | B65D 17/28 |
| 2007/0045317 | A1 * | 3/2007 | Rosender | B65D 43/0249 220/4.23 |
| 2009/0206082 | A1 * | 8/2009 | Vovan | B65D 43/0249 29/428 |
| 2010/0102074 | A1 * | 4/2010 | Parikh | B65D 41/32 220/810 |
| 2011/0056976 | A1 | 3/2011 | Chen | |

(Continued)

FOREIGN PATENT DOCUMENTS

| | | | |
|---|---|---|---|
| JP | 2011-102128 | A2 | 5/2011 |
| KR | 10-2018-0093027 | A | 8/2018 |

OTHER PUBLICATIONS

International Search Report and Written Opinion in related PCT Application PCT/US2024/048125 mailed Apr. 24, 2025, 9 pages.

*Primary Examiner* — James N Smalley
(74) *Attorney, Agent, or Firm* — HOVEY WILLIAMS LLP

(57) ABSTRACT

A tamper evident container comprises a base, a lid, a first hinge, a locking mechanism, a second hinge, and a tamper evidence feature. The base retains items for storage. The lid engages with and covers the base. The first hinge rotatably couples the base and the lid. The locking mechanism secures the lid to the base and includes a plug and a receptacle. The locking mechanism is engaged when the plug is within the receptacle. The second hinge rotatably couples the base and the plug. The tamper evidence feature provides evidence of the container being tampered with or opened and is positioned between the plug and the second hinge.

9 Claims, 9 Drawing Sheets

(56) References Cited

U.S. PATENT DOCUMENTS

| | | | | |
|---|---|---|---|---|
| 2012/0103990 | A1* | 5/2012 | McCumber | B65D 41/165<br>220/270 |
| 2014/0027458 | A1 | 1/2014 | Liu | |
| 2014/0209607 | A1 | 7/2014 | Fosse | |
| 2019/0241328 | A1 | 8/2019 | Fosse | |
| 2024/0239552 | A1* | 7/2024 | Wang | B65D 11/188 |

* cited by examiner

TAMPER EVIDENT CONTAINER

CROSS-REFERENCE TO RELATED APPLICATIONS

The current patent application is a continuation patent application which claims priority benefit, with regard to all common subject matter, of earlier-filed U.S. patent application Ser. No. 18/786,998; titled "TAMPER EVIDENT CONTAINER"; and filed Jul. 29, 2024. The earlier-filed patent application is hereby incorporated by reference, in its entirety, into the current patent application.

FIELD OF THE INVENTION

Embodiments of the current invention relate to small item storage containers which include tamper evident features.

BACKGROUND OF THE INVENTION

A clamshell-like container includes a base and a hinged lid that can be opened and closed. The container may be used to store smaller items such as food, medication, or the like that, once stored in the container, should not be accessed or tampered with before they are ready to be consumed or used. Typically, in order to provide security for the contents, the container includes a locking mechanism, which secures the lid to the base and once locked, cannot easily be unlocked. However, after the container is locked, the container needs to be opened again at some point to access its contents for intended purposes. In addition, the container may be opened to tamper with the contents. It is desirable to know whether the container has been opened either way.

The background discussion is intended to provide information related to the present invention which is not necessarily prior art.

SUMMARY OF THE INVENTION

Embodiments of the current invention address one or more of the above-mentioned topics and provide a container which presents evidence that it has been opened after the container has been locked-even if the container is closed again. The container broadly comprises a base, a lid, a first hinge, a locking mechanism, a second hinge, and a tamper evidence feature. The base retains items for storage. The lid engages with and covers the base. The first hinge rotatably couples the base and the lid. The locking mechanism secures the lid to the base and includes a plug and a receptacle. The locking mechanism is engaged when the plug is within the receptacle. The second hinge rotatably couples the base and the plug. The tamper evidence feature provides evidence of the container being tampered with or opened and is positioned between the plug and the second hinge.

Another embodiment of the current invention provides a container broadly comprising a base, a lid, a first hinge, a locking mechanism, a second hinge, and a tamper evidence feature. The base retains items for storage. The lid engages with and covers the base and includes a top wall. The first hinge rotatably couples the base and the lid. The locking mechanism secures the lid to the base and includes a plug positioned on a panel coupled to the base and a receptacle positioned on an inner surface of the top wall and protruding away from the inner surface. The locking mechanism is engaged when the plug is within the receptacle. The second hinge rotatably couples the base and the plug. The tamper evidence feature provides evidence of the container being tampered with or opened. The tamper evidence feature includes a perforation extending in a line along the panel positioned between the plug and the second hinge.

Yet another embodiment of the current invention provides a container broadly comprising a base, a lid, a first hinge, a locking mechanism, a second hinge, and a tamper evidence feature. The base retains items for storage and includes a bottom wall, first, second, third, and fourth side walls, a platform, a first outer ridge, and a second outer ridge. The first, second, third, and fourth side walls are connected to the bottom wall and to one another to form a quadrilateral shape. The platform is connected to upper edges of each of the side walls and extends outward therefrom. The first outer ridge is positioned on the platform adjacent to the second side wall and protrudes upward therefrom. The first outer ridge has a generally arch-shaped cross section. The second outer ridge is positioned on the platform adjacent to the fourth side wall and protrudes upward therefrom. The second outer ridge has a generally arch-shaped cross section. The lid engages with and covers the base and includes a top wall and an inner ridge. The inner ridge has a quadrilateral shape and is positioned on a lower surface of the top wall. The inner ridge is sized such that an outer edge of the inner ridge sits within, and in contact with, an upper inner surface of the side walls of the base when the lid is closed. The first hinge rotatably couples the base and the lid and includes a first strip, a second strip, and a first crease. The first strip is attached to the base. The second strip is attached to the lid. The first crease includes first and second spaced apart folding sections, each of which can fold or crease. The first crease is attached to the first strip and the second strip to allow the second strip to bend or rotate with respect to the first strip. The locking mechanism secures the lid to the base and includes a plug that is positioned on a panel coupled to the base and a receptacle that is positioned on an inner surface of the top wall and protrudes away from the inner surface. The locking mechanism is engaged when the plug is within the receptacle. The second hinge to rotatably couple the base and the plug and includes a third strip, a fourth strip, and a second crease. The third strip is attached to the base. The fourth strip is attached to the plug. The second crease includes third and fourth spaced apart folding sections, each of which can fold or crease. The second crease is attached to the third strip and the fourth strip to allow the fourth strip to bend or rotate with respect to the third strip. The tamper evidence feature provides evidence of the container being tampered with or opened. The tamper evidence feature includes a perforation extending in a line along the panel positioned between the plug and the second hinge.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF DRAWINGS

Embodiments of the current invention are described in detail below with reference to the attached drawing figures, wherein.

Figure 1:
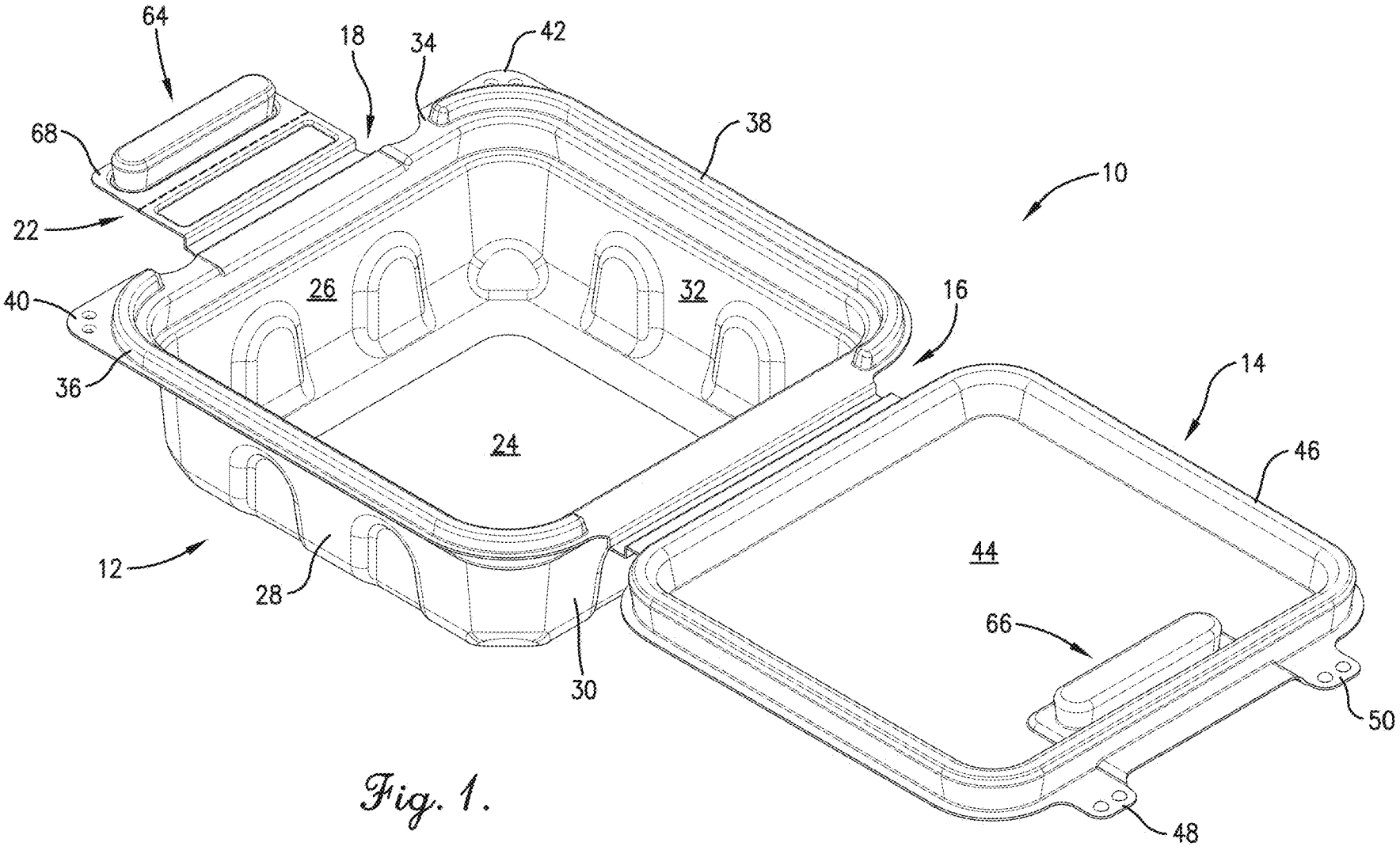
FIG. 1 is an upper perspective view from a first end of a tamper evident container constructed in accordance with various embodiments of the current invention.
Figure 2:
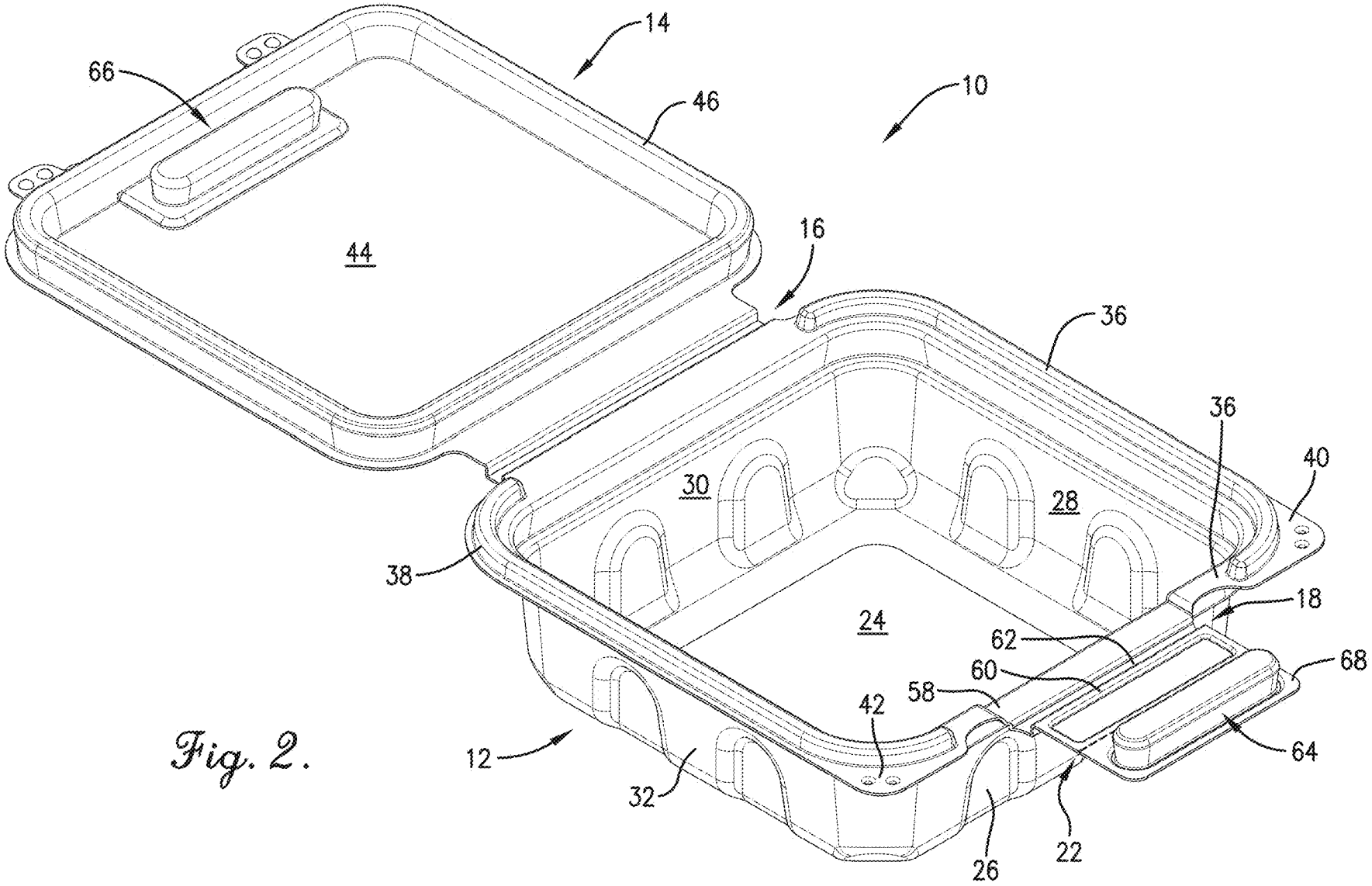
FIG. 2 is an upper perspective view from a second end of the container.
Figure 3:
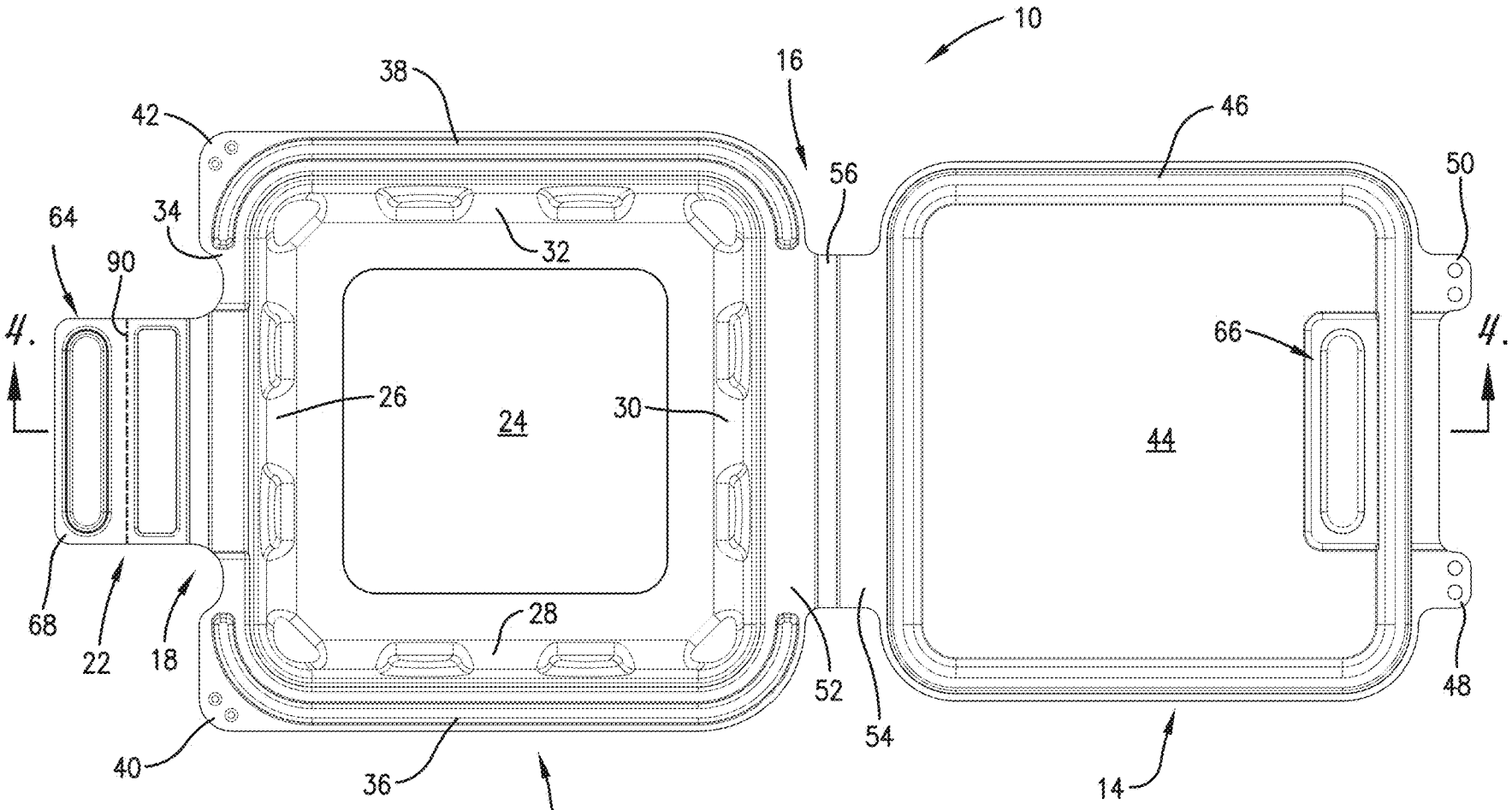
FIG. 3 is a top plan view of the container.
Figure 4:
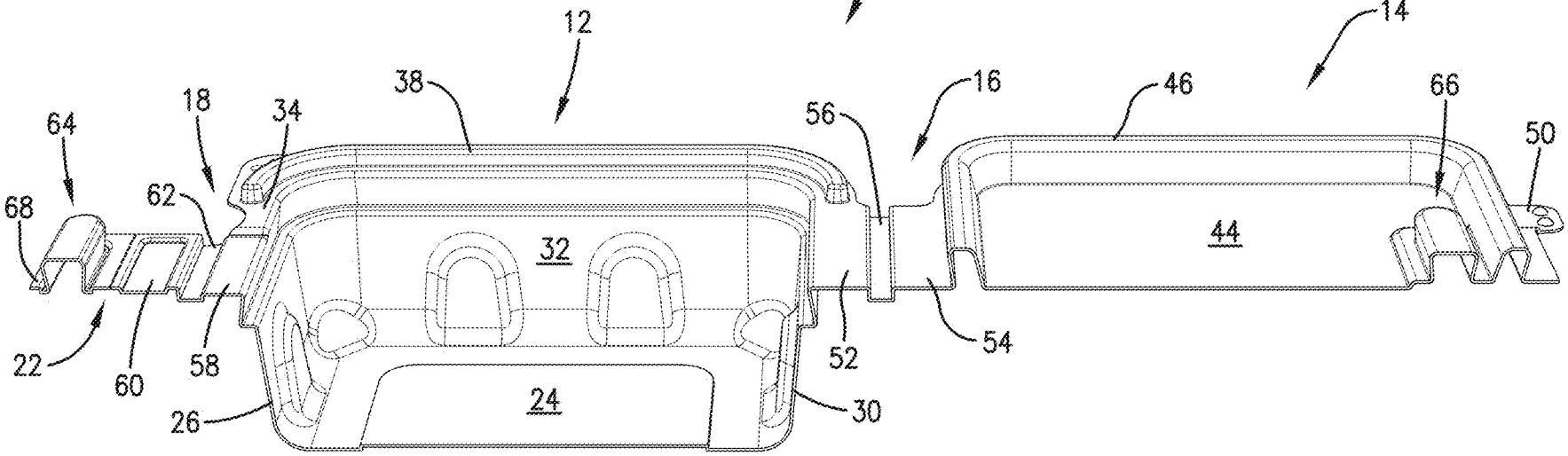
FIG. 4 is a cross sectional view of the container cut along the line 4-4 in FIG. 3.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE INVENTION

The following detailed description of the technology references the accompanying drawings that illustrate specific embodiments in which the technology can be practiced. The embodiments are intended to describe aspects of the technology in sufficient detail to enable those skilled in the art to practice the technology. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

Relational and/or directional terms, such as "above", "below", "up", "upper", "upward", "down", "lower", "downward", "top", "bottom", "outer", "inner", etc., along with orientation terms, such as "horizontal" and "vertical", may be used throughout this description. These terms retain their commonly accepted definitions and are used with reference to embodiments of the technology and the positions, directions, and orientations thereof shown in the accompanying figures. However, embodiments of the technology may be positioned and oriented in other ways or move in other directions. Therefore, the terms do not limit the scope of the current technology.

A container 10 with tamper evident features, constructed in accordance with various embodiments of the current invention, is shown in FIGS. 1-5. The container 10 broadly comprises a base 12 and a lid 14 rotatably coupled to one another wherein the lid 14 can open and close with respect to the base 12 in a "clamshell"-like configuration. The container 10 further comprises a first hinge 16, a second hinge 18, a locking mechanism 20, and a tamper evidence feature 22.

The base 12 generally retains items for storage and includes a bottom wall 24, first through fourth side walls 26, 28, 30, 32, a platform 34, a first outer ridge 36, and a second outer ridge 38. Although the base 12 is shown and described as having four side walls in a square or rectangular configuration, the base 12 may have a single side wall in a circular, oval, or elliptical configuration. Or, the base 12 may include a plurality of side walls, other than four, in a polygon configuration. The bottom wall 24 is generally planar, although it may include one or more raised or recessed portions. The bottom wall 24 has a quadrilateral perimeter with a generally square shape, although it may have a generally rectangular shape as well. Each side wall 26, 28, 30, 32 attaches to the bottom wall 24 along the perimeter thereof, with the first side wall 26 attached along a front side, the second side wall 28 attached along a right side, the third side wall 30 attached along a rear side, and the fourth side wall 32 attached along a left side, such that the bottom wall 24 and the side walls 26, 28, 30, 32 in combination define a base cavity. The intersections between each side wall 26, 28, 30, 32 and the bottom wall 24 as well as the intersections between each pair of adjacent side walls 26, 28, 30, 32 may be rounded, bull nosed, or chamfered. In addition, each side wall 26, 28, 30, 32 may be angled outward slightly as it extends upward from the bottom wall 24. Furthermore, each side wall 26, 28, 30, 32 may include one or more raised or recessed features.

The platform 34 is attached to an upper edge of each side wall 26, 28, 30, 32 and extends outward therefrom to define an upper perimeter of the base 12. The first outer ridge 36 and the second outer ridge 38 are positioned on an upper surface of the platform 34 and projects upward therefrom. Each outer ridge 36, 38 extends along the majority, or entirety, of one side of the platform 34 and at least a portion of the two adjacent sides of the platform 34. For example, the first outer ridge 36 extends along the right side of the platform 34 (above the second side wall 28) and a portion of each of the front side and the rear side of the platform 34. The second outer ridge 38 extends along the left side of the platform 34 (above the fourth side wall 32) and a portion of each of the front side and the rear side of the platform 34. Each outer ridge 36, 38 has an arch, or inverted U, cross-sectional shape with an outer edge and an opposing inner edge, wherein the outer edge is positioned inward from the perimeter of the platform 34.

The base 12 further includes first and second base tabs 40, 42 which protrude outward from a front edge of the platform 34. The first base tab 40 is positioned on a first corner of the front edge of the platform 34, and the second base tab 42 is positioned on a second, opposing corner of the front edge of the platform 34.

The lid 14 generally engages with and cover the base 12 and has a top wall 44 and an inner ridge 46. The top wall 44 is generally planar and, corresponding to the bottom wall 24, has a quadrilateral perimeter with a roughly square shape, although it may have a roughly rectangular shape as well. Likewise as with the base 12, the lid 14 may have other shapes as well such as rounded or polygonal. The inner ridge 46 has a quadrilateral shape and is positioned on a lower surface of the top wall 44 (wherein relative terms like "upper" and "lower" for the lid 14 are used with reference to FIG. 5, in which the lid 14 is closed, i.e., in contact with the base 12) and projects downward therefrom. The inner ridge 46 has an arch, or inverted U, cross-sectional shape with an outer edge and an opposing inner edge. The outer edge of the inner ridge 46 is positioned inward from the perimeter of the top wall 44. In addition, the inner ridge 46 (and, to a certain extent, the top wall 44) is sized such that the outer edge of the inner ridge 46 sits just within, and in contact with, the upper inner surface of the side walls 26, 28, 30, 32 of the base 12 when the lid 14 is closed.

The lid 14 further includes first and second lid tabs 48, 50 which protrude outward from a front edge of the top wall 44.

The first lid tab 48 is positioned on the front edge of the top wall 44 offset and inward from the first base tab 40. The second lid tab 50 is positioned on the front edge of the top wall 44 offset and inward from the second base tab 42.

The first hinge 16 rotatably couples the base 12 and the lid 14 and is attached to a rear edge of the platform 34 and a rear edge of the top wall 44. The first hinge 16 may include a first strip 52, a second strip 54, and a first crease 56. The first strip 52 is attached to the platform 34 along one side and to the first crease 56 along the opposing side. The second strip 54 is attached to the top wall 44 along one side and to the first crease 56 along the opposing side. The first crease 56 includes first and second spaced apart folding sections, each of which fold or crease, that allow the second strip 54 to bend or rotate with respect to the first strip 52.

The second hinge 18 rotatably couples the base 12 and a part of the locking mechanism 20 and is attached to a front edge of the platform 34. The second hinge 18 may include a third strip 58, a fourth strip 60, and a second crease 62. The third strip 58 is attached to the platform 34 along one side and to the second crease 62 along the opposing side. The fourth strip 60 is attached to the second crease 62 along one side and to the front edge of a panel 68 supporting a portion of the locking mechanism 20 along the other side. The second crease 62 includes third and fourth spaced apart folding sections, each of which fold or crease, that allow the fourth strip 60 to bend or rotate with respect to the third strip 58.

The locking mechanism 20 generally secures the lid 14 to the base 12 and includes a plug 64 and a receptacle 66 that couple to one another in a tongue in groove fashion when the locking mechanism 20 is locked. The plug 64 is positioned on the panel 68 that is attached, through the second hinge 18, to the platform 34 of the base 12. The plug 64 projects upward from an upper surface of the panel 68 and includes a plug front wall 70, an opposing plug rear wall 72, a plug left wall 74, an opposing plug right wall 76, and a plug bottom wall 78. The plug front wall 70, the plug rear wall 72, the plug left wall 74, and the plug right wall 76 are each connected to the plug bottom wall 78. The intersections between each plug side wall 70, 72, 74, 76 and the plug bottom wall 78 as well as the intersections between each pair of adjacent plug side walls 70, 72, 74, 76 may be rounded, bull nosed, or chamfered. In addition, each plug side wall 70, 72, 74, 76 may be angled inward slightly as it extends upward from the plug bottom wall 78, as shown in FIGS. 7 and 8.

The receptacle 66 is positioned on the lower surface of the top wall 44 inward from the inner edge of the inner ridge 46. In some embodiments, the receptacle 66 may be positioned on a raised or recessed portion of the top wall 44. The receptacle 66 projects downward from the top wall 44 and includes a receptacle front wall 80, an opposing receptacle rear wall 82, a receptacle left wall 84, an opposing receptacle right wall 86, and a receptacle bottom wall 88. The receptacle front wall 80, the receptacle rear wall 82, the receptacle left wall 84, and the receptacle right wall 86 are each connected to the receptacle bottom wall 88 to create the boundaries of a receptacle cavity. The intersections between each receptacle side wall 80, 82, 84, 86 and the receptacle bottom wall 88 as well as the intersections between each pair of adjacent receptacle side walls 80, 82, 84, 86 may be rounded, bull nosed, or chamfered. In addition, each receptacle side wall 80, 82, 84, 86 may be angled inward slightly as it extends upward from the receptacle bottom wall 88, as shown in FIGS. 7 and 8.

Figure 5:
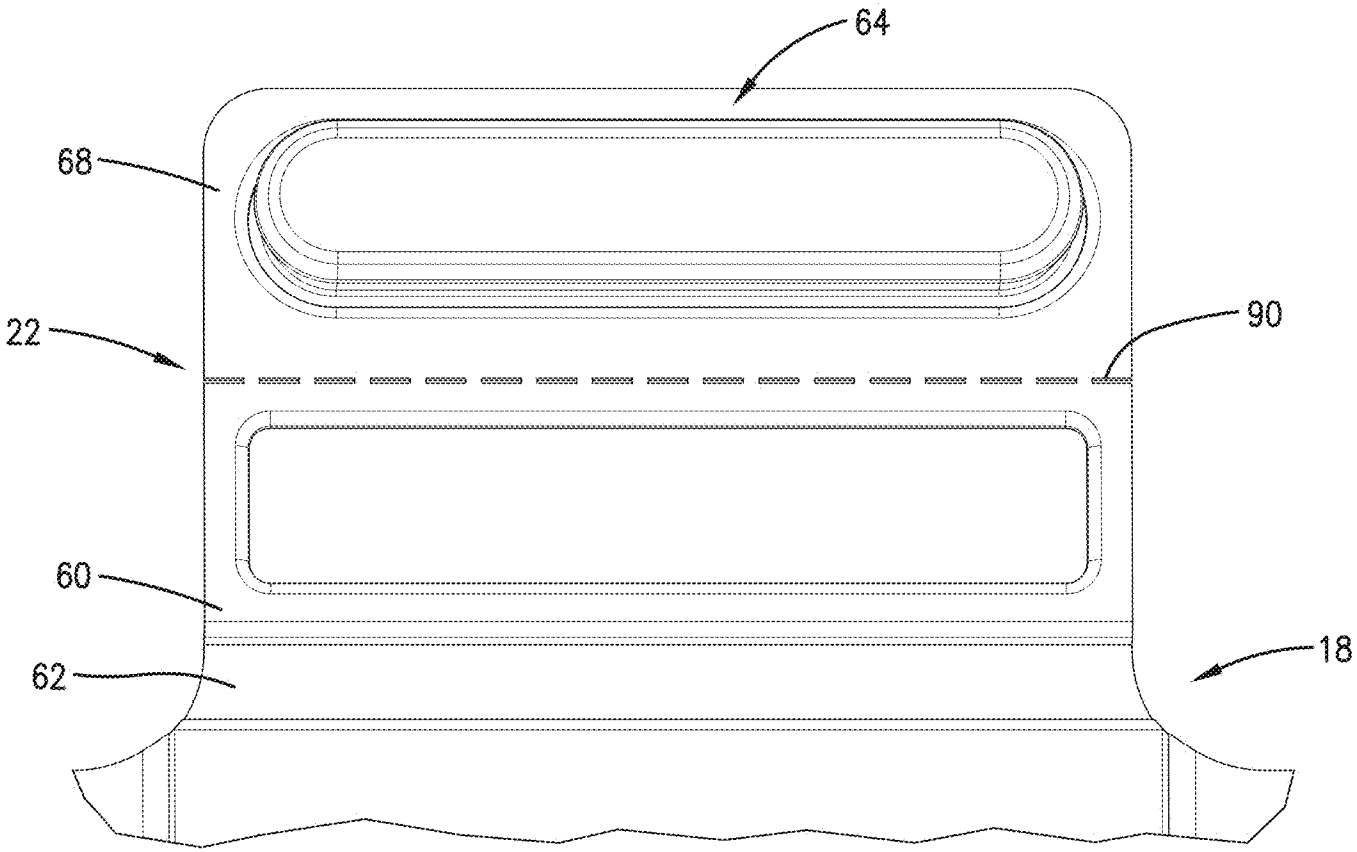
FIG. 5 is a top plan view of a tamper evidence feature and a plug component of a locking mechanism.

The tamper evidence feature 22 generally provides evidence that someone has opened the container 10, or at least, has tried to open the container 10. As best shown in FIG. 5, the tamper evidence feature 22 includes a perforation 90 of the material between the panel 68 on which the plug 64 is positioned and the fourth strip 60. The perforation may include a series of aligned, spaced apart cuts, through holes, or openings. Alternatively, the tamper evidence feature 22 may not include the perforation 90, but instead may include a thinning of the material along a line where the perforation 90 would be to make it easier to tear or break the fourth strip 60 from the panel 68.

Figure 6:
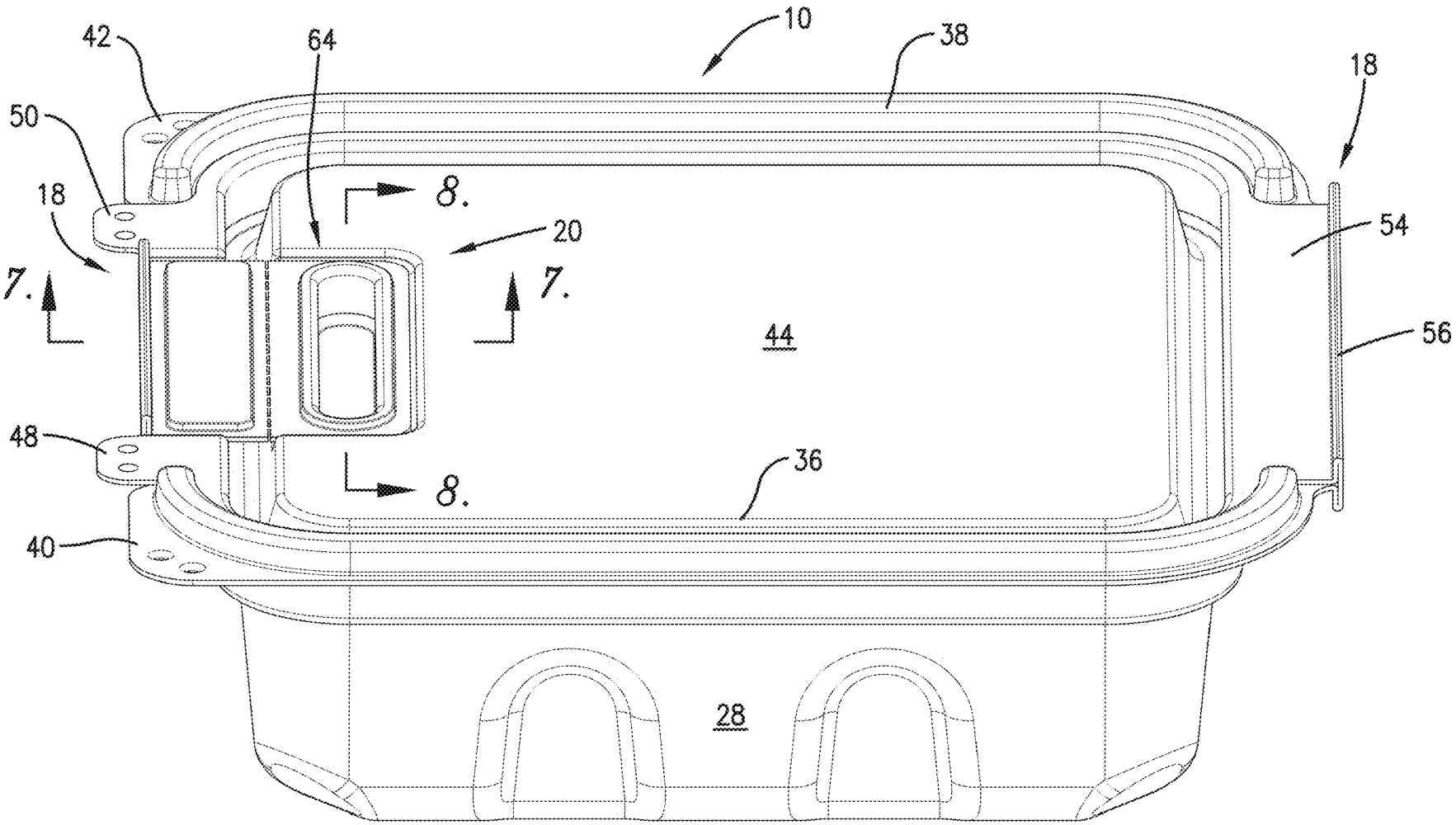
FIG. 6 is an upper perspective view of the container with a lid closed and the locking mechanism engaged.
Figure 7:
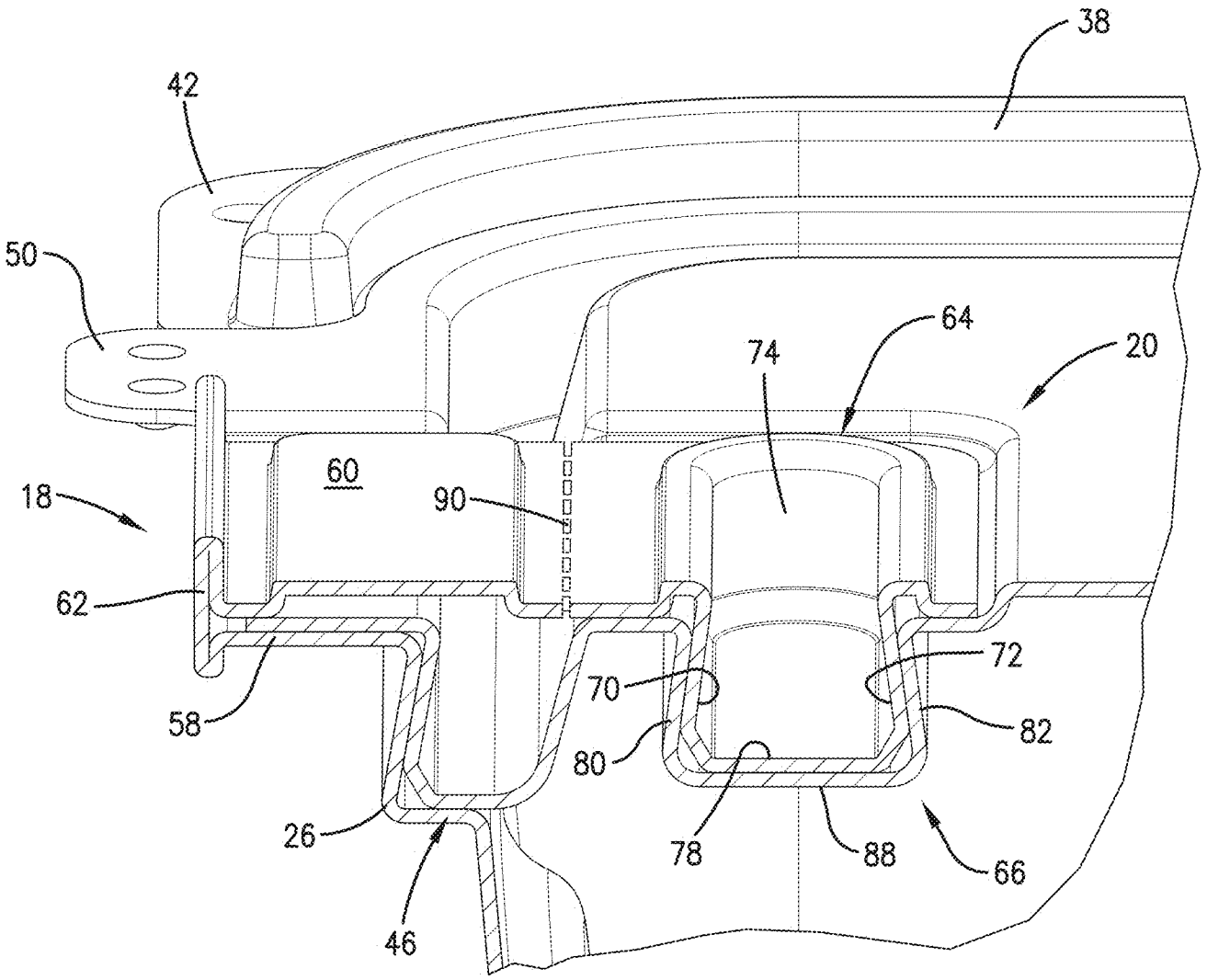
FIG. 7 is a cross-sectional view of the locking mechanism cut along the line 7-7 of FIG. 6 and illustrating a plug inserted into a receptacle.
Figure 8:
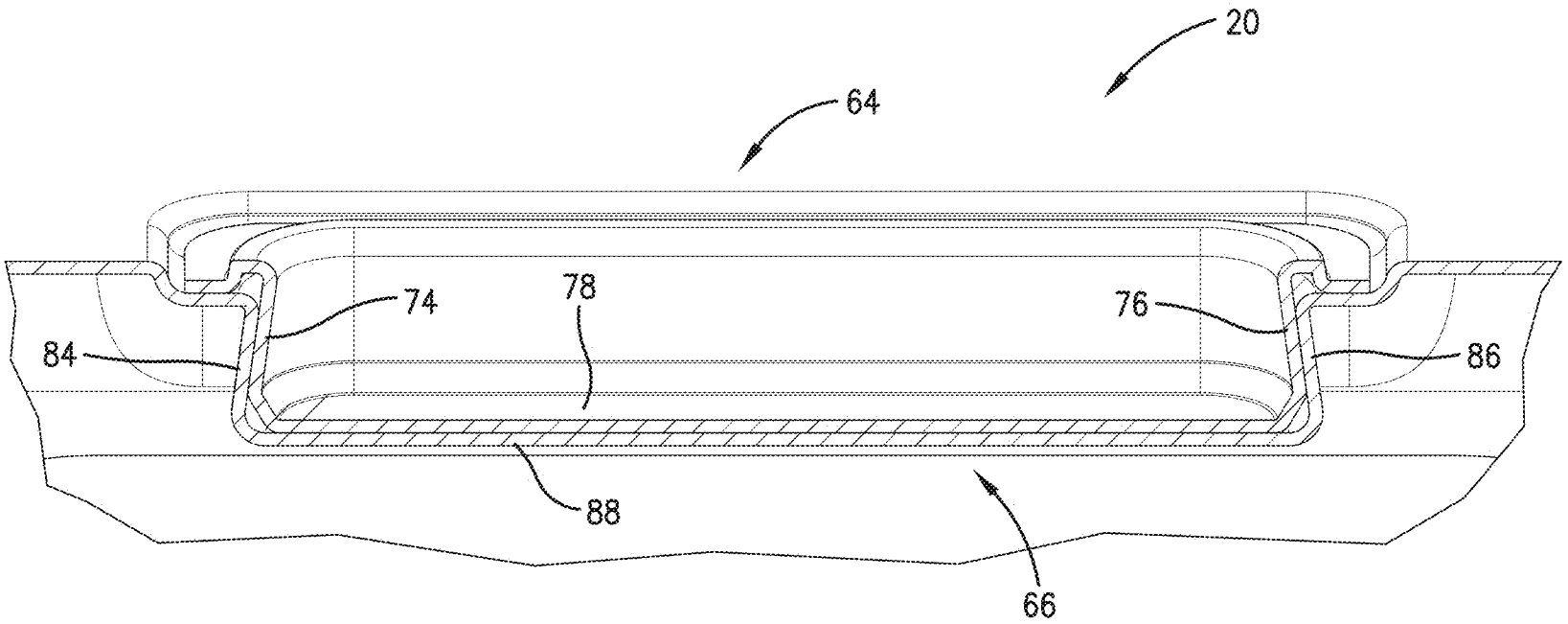
FIG. 8 is a cross-sectional view of the locking mechanism cut along the line 8-8 of FIG. 6 and illustrating the plug inserted into the receptacle.

Referring to FIGS. 6-8, the locking mechanism 20 may operate as follows. Assuming the lid 14 is open, then the lid 14 is folded over onto the base 12 such that the inner ridge 46 of the lid 14 fits within the first outer ridge 36 and the second outer ridge 38 of the base 12. At least a portion of the outer edge of the inner ridge 46 contacts at least a portion of the upper inner surface of the side walls 26, 28, 30, 32 of the base 12. The plug 64 is folded over onto the receptacle 66 and inserted into the receptacle 66. Given that the widest dimensions of the plug side walls 70, 72, 74, 76 are greater than the narrowest dimensions of the receptacle side walls 80, 82, 84, 86, downward pressure is applied to the plug 64 to momentarily inwardly collapse the plug side walls 70, 72, 74, 76 and/or momentarily outwardly expand the receptacle side walls 80, 82, 84, 86 such that the plug 64 fits within the receptacle 66, similar to the operation of a snap. At least a portion of each of the outer surfaces of the plug side walls 70, 72, 74, 76 contact at least a portion of each of the inner surfaces of the like-named receptacle side walls 80, 82, 84, 86, respectively. Once the locking mechanism 20 is engaged, the plug 64 cannot be removed from the receptacle 66 without damage likely being caused to the plug 64, the receptacle 66, or both.

Figure 9:
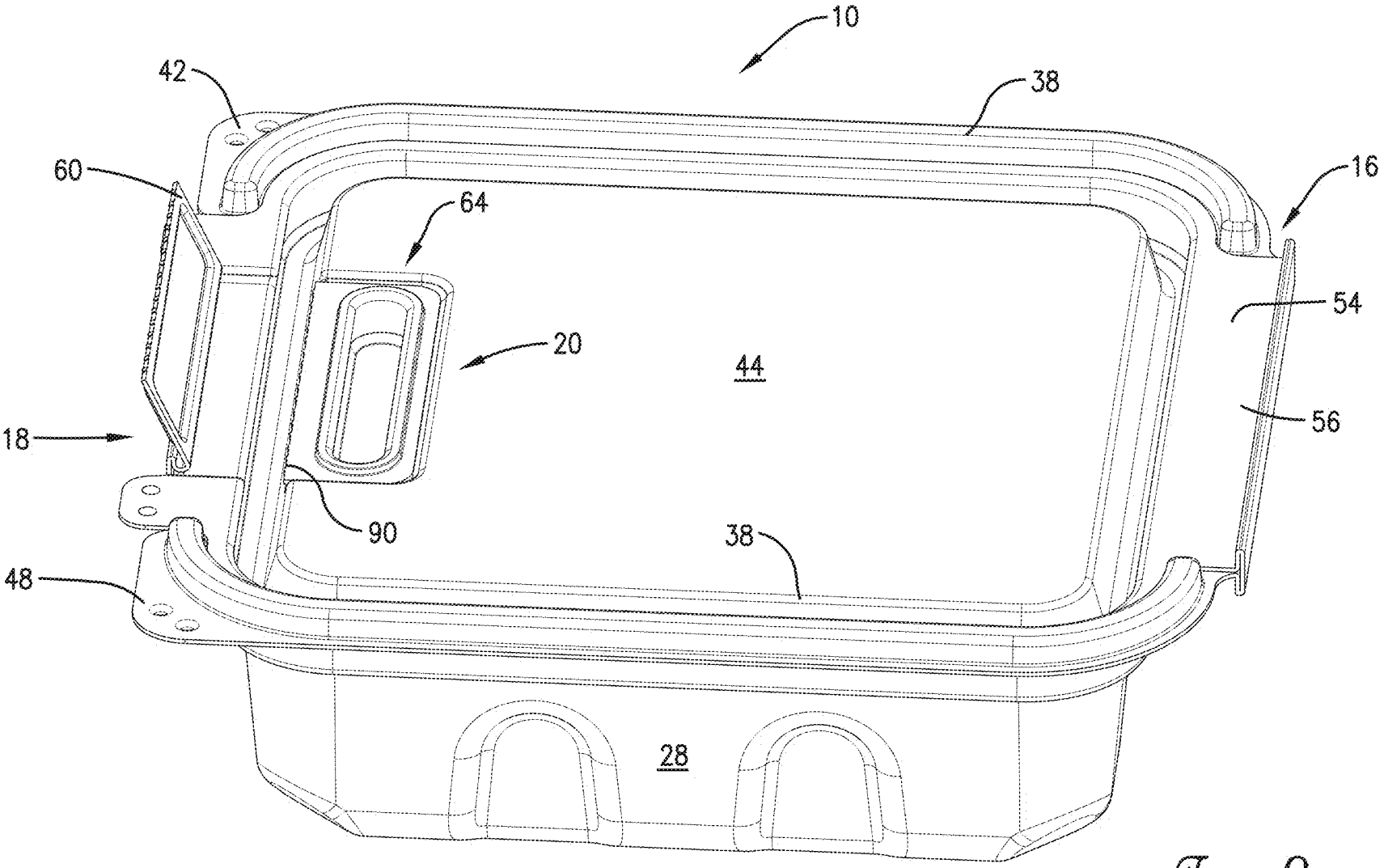
FIG. 9 is an upper perspective view of the container with the lid closed and the locking mechanism engaged, but the lid has been opened or tampered with and the tamper evidence feature is broken.

Referring to FIG. 9, evidence of tampering with or opening the container 10 is shown, wherein the perforation 90 has been broken, such as by lifting the lid 14 with the locking mechanism 20 engaged, and the lid 14 has been closed again. Anyone trying to open the lid 14 after the locking mechanism 20 is engaged, i.e., the plug 64 is fully inserted into the receptacle 66, will have to break the perforation 90 between the panel 68 and the fourth strip 60. To open the lid 14, the first and/or second base tabs 40, 42 may be held while the first and/or second lid tabs 48, 50 are pulled upward (away from the base 12). The perforation 90 may break with the application of a separation force between the base 12 and the lid 14. Afterward, the perforation 90 remains broken even if the lid 14 is closed again.

Embodiments of the container 10 have the following beneficial features. The tamper evidence feature 22 being the perforation 90 between two fixed components, i.e., the locking mechanism 20 and the second hinge 18, means that no pieces of the container 10 are removed after the perforation 90 is broken and the container 10 is opened. Accordingly, nothing of the container 10 can fall away and potentially become litter. In addition, the first hinge 16 connecting the base 12 and the lid 14 is not part of the tamper evidence feature 22 and remains intact after the perforation 90 is broken and the container 10 is opened. Thus, the lid 14 remains with the container 10 and can conveniently be closed and sealed even after the perforation 90 is broken.

Throughout this specification, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current invention can include a variety of combinations and/or integrations of the embodiments described herein.

Although the present application sets forth a detailed description of numerous different embodiments, it should be understood that the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim(s).

Although the technology has been described with reference to the embodiments illustrated in the attached drawing figures, it is noted that equivalents may be employed and substitutions made herein without departing from the scope of the technology as recited in the claims.

Having thus described various embodiments of the technology, what is claimed as new and desired to be protected by Letters Patent includes the following:

1. A tamper evident container comprising:

a base to retain items for storage, the base including:

a bottom wall, first, second, third, and fourth side walls connected to the bottom wall and to one another to form a quadrilateral shape, a platform connected to upper edges of each of the side walls and extending outward therefrom, a first outer ridge positioned on the platform adjacent to the second side wall and protruding upward therefrom, and a second outer ridge positioned on the platform adjacent to the fourth side wall protruding upward therefrom;

a lid to engage with and cover the base, the lid including:

a top wall, and an inner ridge having a quadrilateral shape and positioned on a lower surface of the top wall, the inner ridge being sized such that an outer edge of the inner ridge sits within, and in contact with, an upper inner surface of the side walls of the base when the lid is closed;

a first hinge to rotatably couple the base and the lid;

a locking mechanism to secure the lid to the base, the locking mechanism including a plug and a receptacle, the locking mechanism being engaged when the plug is within the receptacle, the plug and the receptacle each including side walls that are tapered inward to prevent removal of the plug from the receptacle when the locking mechanism is engaged;

a second hinge to rotatably couple the base and the plug; and a tamper evidence feature to provide evidence of the container being tampered with or opened, the tamper evidence feature positioned between the plug and the second hinge.

2. The tamper evident container of claim 1, wherein the lid includes a top wall, and the receptacle is positioned on an inner surface of the top wall and protrudes away from the inner surface.

3. The tamper evident container of claim 1, wherein the tamper evidence feature includes a perforation extending in a line along a panel on which the plug is positioned.

4. The tamper evident container of claim 3, wherein the perforation is broken when the lid is opened after the locking mechanism is engaged.

5. The tamper evident container of claim 1, wherein the plug includes a plug front wall, an opposing plug rear wall, a plug left wall, and an opposing plug right wall, each wall connected to a plug bottom wall and tapered inward when extending from the plug bottom wall, the receptacle includes a receptacle front wall, an opposing receptacle rear wall, a receptacle left wall, and an opposing receptacle right wall, each wall connected to a receptacle bottom wall to form a receptacle cavity, each wall being tapered inward when extending from the receptacle bottom wall, and the walls of the plug fit irremovably within the receptacle cavity when the locking mechanism is engaged.

6. The tamper evident container of claim 1, wherein the first outer ridge and the second outer ridge each have a generally arch-shaped cross section.

7. The tamper evident container of claim 1, wherein the inner ridge has a generally arch-shaped cross section.

8. The tamper evident container of claim 1, wherein the first hinge includes:

a first strip attached to the base, a second strip attached to the lid, and a first crease including first and second spaced apart folding sections, each of which fold or crease, the first crease attached to the first strip and the second strip to allow the second strip to bend or rotate with respect to the first strip.

9. The tamper evident container of claim 1, wherein the second hinge includes:

a third strip attached to the base, a fourth strip attached to the plug, and a second crease including third and fourth spaced apart folding sections, each of which fold or crease, the second crease attached to the third strip and the fourth strip to allow the fourth strip to bend or rotate with respect to the third strip.

* * * * *